US010613570B1

(12) United States Patent
Codega et al.

(10) Patent No.: US 10,613,570 B1
(45) Date of Patent: Apr. 7, 2020

(54) BANDGAP CIRCUITS WITH VOLTAGE CALIBRATION

(71) Applicant: Inphi Corporation, Santa Clara, CA (US)

(72) Inventors: Nicola Codega, Colorina (IT); Fabio Giunco, Tortona (IT); Giovanni Cesura, Cremona (IT)

(73) Assignee: INPHI CORPORATION, Santa Clara, CA (US)

( * ) Notice: Subject to any disclaimer, the term of this patent is extended or adjusted under 35 U.S.C. 154(b) by 0 days.

(21) Appl. No.: 16/222,929

(22) Filed: Dec. 17, 2018

(51) Int. Cl.
*G05F 3/24* (2006.01)
*G05F 3/26* (2006.01)

(52) U.S. Cl.
CPC ..... *G05F 3/262* (2013.01); *G05F 3/265* (2013.01)

(58) Field of Classification Search
CPC . G05F 3/30; G05F 3/262; G05F 3/265; H03F 3/345; H01L 27/0705
USPC ..... 323/311–316, 906, 907; 327/307, 513, 327/539–543
See application file for complete search history.

(56) References Cited

U.S. PATENT DOCUMENTS 5,629,611 A * 5/1997 McIntyre ..... G05F 3/267 323/313
6,160,391 A * 12/2000 Banba ..... G05F 3/242 323/313
6,933,770 B1 * 8/2005 Ranucci ..... G05F 3/30 257/E27.029
7,164,259 B1 * 1/2007 Megaw ..... G05F 3/30 323/313
7,453,252 B1 * 11/2008 Megaw ..... G05F 3/30 323/313
7,821,331 B2 * 10/2010 Krishna ..... G05F 3/30 323/313
8,008,966 B2 * 8/2011 Cho ..... G05F 3/30 323/313
8,294,450 B2 * 10/2012 Lee ..... G05F 3/30 323/315
2009/0237150 A1 * 9/2009 Tsai ..... G05F 3/30 327/539

* cited by examiner

*Primary Examiner* — Rajnikant B Patel
(74) *Attorney, Agent, or Firm* — Richard T. Ogawa; Ogawa P.C.

(57) ABSTRACT

A bandgap circuit generates a process and temperature independent voltage. The bandgap circuit includes a bandgap core that generates a temperature independent voltage. The bandgap circuit also includes a resistor ladder that is coupled in parallel to the bandgap core and scales the temperature independent voltage into voltage levels proportional to the temperature independent voltage. An output switch of the bandgap circuit connects the output of the bandgap circuit to one of the voltage level that is substantially equal to a desired voltage level. The bandgap circuit may also include a current mirror that outputs a proportional to absolute temperature current.

18 Claims, 2 Drawing Sheets

100

BANDGAP CIRCUITS WITH VOLTAGE CALIBRATION

BACKGROUND

1. Field of the Disclosure

This disclosure pertains in general to integrated circuits, and more specifically to bandgap reference voltage calibration.

2. Description of the Related Art

Bandgap circuits generate voltages that are independent of process, temperature, and voltage supply (PVT variations) and are vastly used in integrated circuits. However, the output voltage of a bandgap circuit may drift as a result of any variation in fundamental parameters: threshold voltages of transistors, resistor ratios, or geometrical parameters. Consequently, reference voltages derived from its output voltage will also be inaccurate, which may cause these integrated circuits to incur substantial operation errors. It is important to ensure that output voltages of bandgap circuit have a flat profile over PVT.

SUMMARY

A bandgap circuit generates a process, power supply, and temperature independent output voltage. The bandgap circuit can be integrated with other circuits of an integrated circuit (IC) and its absolute output voltage value can be calibrated to a desired voltage level. As such, the variation in absolute voltage levels which may be caused by variation in devices' parameters subject to different fabrication processes is minimized or substantially eliminated. The bandgap circuit includes a bandgap core that generates a temperature independent voltage. The bandgap circuit also includes a resistor ladder that is coupled in parallel to the bandgap core and scales the temperature independent voltage into voltage levels proportional to the temperature independent voltage. An output switch of the bandgap circuit selects the voltage level on the resistor ladder that is substantially equal to a desired voltage level. The bandgap circuit also includes a current mirror that outputs a proportional to absolute temperature (PTAT) current.

Other aspects include components, devices, systems, improvements, methods, processes, applications and other technologies related to the foregoing.

BRIEF DESCRIPTION OF THE DRAWINGS

The teachings of the embodiments disclosed herein can be readily understood by considering the following detailed description in conjunction with the accompanying drawings.

DETAILED DESCRIPTION

The Figures and the following description relate to various embodiments by way of illustration only. It should be noted that from the following discussion, alternative embodiments of the structures and methods disclosed herein will be readily recognized as viable alternatives that may be employed without departing from the principles discussed herein. Reference will now be made in detail to several embodiments, examples of which are illustrated in the accompanying figures. It is noted that wherever practicable similar or like reference numbers may be used in the figures and may indicate similar or like functionality.

Figure 1:
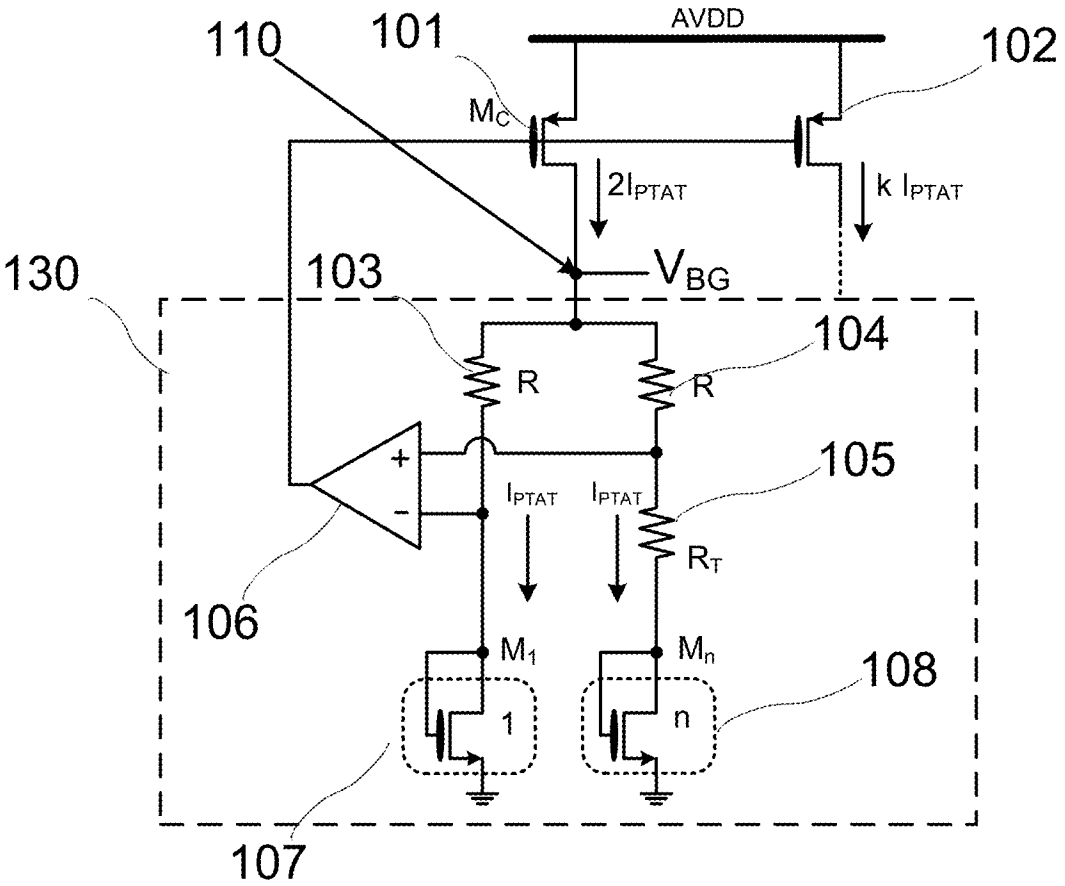
FIG. 1 illustrates an example bandgap circuit.

FIG. 1 illustrates an example bandgap circuit 100. As illustrated, the example bandgap circuit 100 includes transistors 101-102, resistors 103-105, an operational amplifier (Op Amp) 106, and transistors 107-108. The transistors 101-102 are P-type Metal-Oxide-Semiconductor (PMOS) transistors, and the transistors 107-108 are N-type Metal-Oxide-Semiconductor (NMOS) transistors. The bandgap core 130 that outputs a bandgap voltage $V_{BG}$ includes the resistors 103-105, Op Amp 106, and transistors 107-108. As described herein, the bandgap voltage $V_{BG}$ is a temperature independent voltage. The bandgap core 130 can be integrated in integrated circuits to provide the bandgap voltage $V_{BG}$ regardless of power supply variations, temperature changes, and circuit loading of the integrated circuits. Compared to using external voltage references, integrated bandgap circuits are less noisy, less power-hungry, and provide a wider voltage range that is less susceptible to temperature.

The transistor 107 is coupled in series with a resistor 103, which is further referred to as the first branch. The transistor 108 is coupled in series with resistors 104-105, which is further referred to as the second branch. The transistor 108 is n-times bigger than the transistor 107 in dimension. That is, the current capability and the amplification factor of the transistor 108 is n-times of that of the transistor 107. The two branches are connected in parallel between the ground and the transistor 101. The resistors 103 and 104 are equal and both coupled to the transistor 101 which is further coupled to the power supply voltage. The Op Amp 106 forces its positive and negative inputs to be at the same voltage. As a result, the currents flowing through the resistors 103-104 are equal. The currents flowing through the transistors 107 and 108 are also equal. The transistors 107 and 108 are of different dimensions: the transistor 108 is n times bigger than the transistor 107. Hence, the gate to source threshold voltage of the transistor 107 is higher than that of the transistor 108. In the second branch, this threshold voltage difference between the transistors 107 and 108 is equal to the voltage drop over the resistor 105. From physics, this threshold voltage difference is proportional to absolute temperature. The current flowing through the resistor 105 equals to this voltage drop divided by the resistance of the resistor 105. Therefore this current is proportional to absolute temperature (PTAT) current $I_{PTAT}$. In the illustrated example, the transistors 107 and 108 are selected such that the temperature coefficient of the threshold voltage difference between the transistors 107, 108 multiplied by a factor is the opposite of that of the threshold voltage of the transistor 107. For example, the threshold voltage of the transistor 108 has a temperature coefficient of −2 mV/K and the threshold voltage difference between the transistors 107, 108 multiplied by an appropriate factor can have the opposite temperature coefficient of +2 mV/K. As such, if the temperature varies, the variation in the voltage across the resistor 104 counteracts the transistor 108 voltage variation. The voltage $V_{BG}$ is therefore substantially constant and temperature independent.

The transistor 101 is controlled to provide the current through both branches. In the illustrated example, the transistor 101 is controlled by a feedback loop including the Op Amp 106. The feedback loop is configured to compare the voltage on both branches and to control the transistor 101 to equalize the current flowing through both branches. The bandgap circuit 100 outputs an output voltage $V_{BG}$ at the node 110. The output voltage $V_{BG}$ is the power supply voltage minus the voltage drop across the transistor 101. Because the current flowing through both branches is substantially equal and substantially proportional to absolute temperature, the bandgap circuit 100 outputs the output voltage $V_{BG}$ that is substantially constant and temperature independent.

The bandgap circuit 100 can further output a current that is proportional to absolute temperature (PTAT). For example, in the illustrated example, the transistor 102 is configured to output an output current. The transistors 101 and 102 are connected to form a current mirror. The current through the transistor 102 mirrors the current through the transistor 101.

For the topology illustrated in FIG. 1, the absolute value of the output voltage $V_{BG}$ may vary from one circuit to another, however keeping the temperature independence. This variation in the output voltage absolute value is caused by variation in individual devices (e.g., Bipolar Junction Transistors (BJTs), metal-oxide semiconductor field-effect transistor (MOSFETs), resistors, Op Amps) used in different circuits, even though the output voltage $V_{BG}$ of a circuit can be temperature independent. For example, devices manufactured by different fabrication processes may have different parameters. To substantially minimize or eliminate this variation in the absolute value of the output voltage $V_{BG}$ generated by bandgap circuits that employ different individual devices manufactured by different fabrication processes, the bandgap circuits are calibrated. One example is described in connection with FIG. 2.

Figure 2:
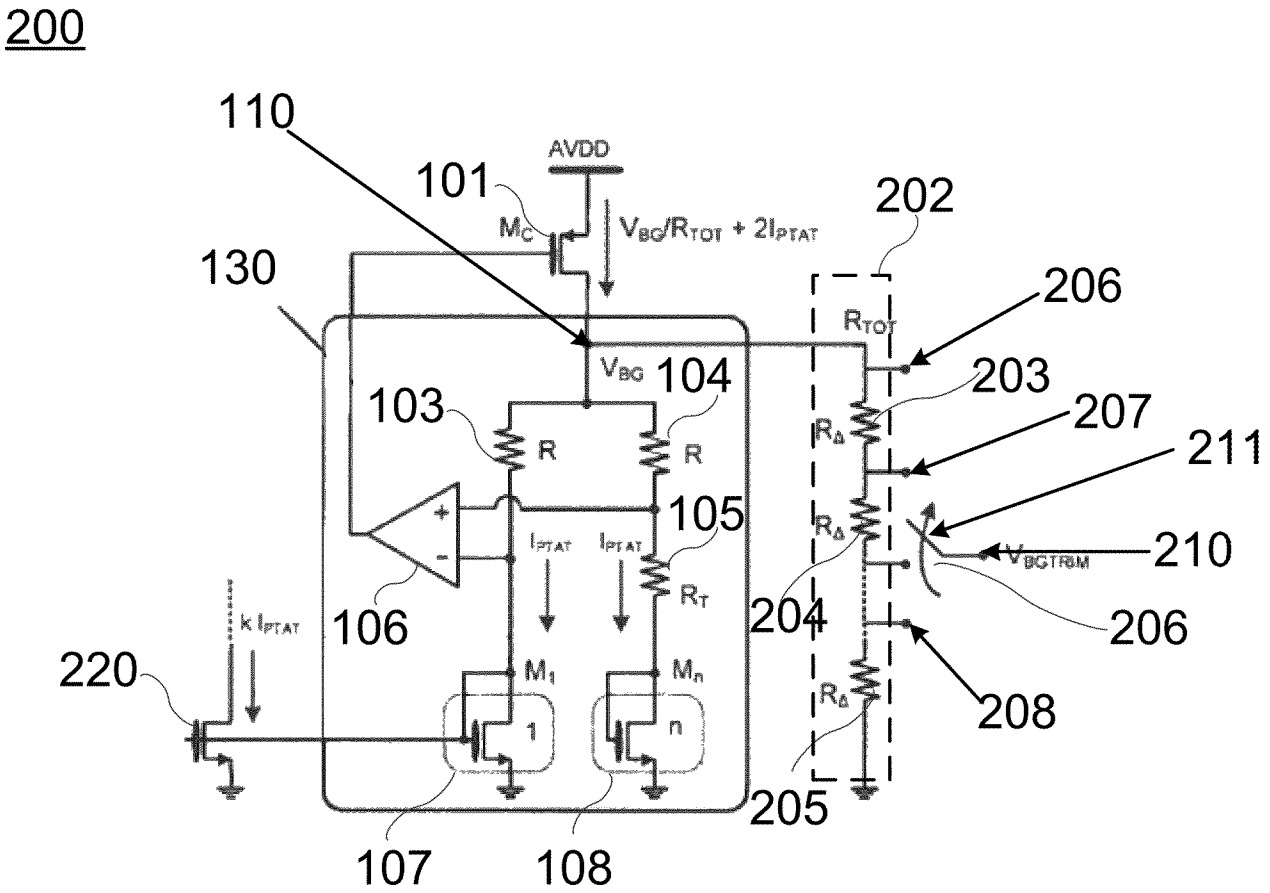
FIG. 2 illustrates an example bandgap circuit, according to one embodiment.

FIG. 2 illustrates an example bandgap circuit 200 that outputs a calibrated voltage. That is, the output voltage of the bandgap circuit 200 can be calibrated to a desired voltage level. The bandgap circuit 200 includes the transistor 101, a bandgap core 130, a resistor ladder 202, an output switch 206, and a transistor 220. The transistor 101 and the bandgap core 130 are described above in connection with FIG. 1. In the illustrated example, the transistor 220 is a NMOS transistor. The example bandgap circuit 200 can be integrated in many systems, such as Serializer/Deserializers and memories.

The resistor ladder 202 scales the output voltage and includes multiple resistors connected in series. In the illustrated example, three resistors 203, 204, 205 are connected in series. The resistor ladder 202 is coupled in parallel to the output of the bandgap core 130. As illustrated, one terminal of the resistor ladder 202 (i.e., one terminal of the resistor 203) is coupled to the node 110 of the bandgap core 130. The other terminal of the resistor ladder 202 (i.e., one terminal of the resistor 205) is grounded. In the illustrated example, the resistor ladder 202 divides the output voltage $V_{BG}$ of the bandgap core 130 into three equal portions each of which is the voltage across an individual resistor 203, 204, 205. That is, the voltage across the resistor 205 (204 or 203) is $\frac{1}{3}V_{BG}$.

The output switch 206 switches between different voltage levels. The terminal 210 of the switch 206 is the output terminal of the bandgap circuit 200. The other terminal 211 of the switch 206 can switch between the three taps 206, 207, 208. The three taps 206, 207, 208 are connected to a first terminal of the resistor 203, a second terminal of the resistor 203 (also a first terminal of the resistor 204), and a second terminal of the resistor 204 (also a first terminal of the resistor 205). As such, the output voltage $V_{BGTRIM}$ of the bandgap circuit 200 can be calibrated by selecting a voltage level that is proportional to the output voltage $V_{BG}$ of the bandgap circuit 200. In the illustrated example, the output voltage $V_{BGTRIM}$ of the bandgap circuit 200 can be selected from $\frac{1}{3} \geq V_{BG}$, $\frac{2}{3} \geq V_{BG}$, and $V_{BG}$.

The number of resistors is configured according to a desired level of voltage adjustment. In the illustrated example, the resistor ladder 202 includes only three resistors and thus the output voltage $V_{BGTRIM}$ can be calibrated by a voltage adjustment of $\frac{1}{3}$ $V_{BG}$. To achieve an adjustment of a smaller or larger voltage level, more or fewer resistors can be used. For example, 4 resistors can be used to provide a voltage adjustment of $\frac{1}{4}$ $V_{BG}$, and 5 resistors can be used to provide a voltage adjustment of $\frac{1}{5}$ $V_{BG}$. In various embodiments, the resistors included in the resistor ladder have the same resistance that is in the kilo-ohm range. In one embodiment, the voltage adjustment is 5 mV.

To calibrate the output voltage $V_{BGTRIM}$ of the bandgap circuit 200, a desired voltage level is provided and compared to the different voltage levels at different taps. The tap corresponding to a voltage level that is substantially equal to the desired voltage level is selected. The switch 211 is switched to this tap. The calibration process can be performed manually or by a calibration circuit or a calibration program automatically. For example, a calibration circuit compares the output voltage $V_{BGTRIM}$ to a desired voltage level using a comparator. The desired voltage level can be provided by a voltage reference such as a voltage supply partition. One input terminal of the comparator is coupled to the voltage reference and the other input terminal is coupled to the node 210 ($V_{BGTRIM}$) of the bandgap circuit 200. The calibration circuit can switch the terminal 211 of the switch to connect to different taps of the resistor ladder 202. The calibration circuit switches select the tap corresponding to a voltage level that is closest to the desired voltage level. Calibration may substantially minimize the variation in the output voltage across different chips that is caused by devices manufactured by different fabrication processes.

The calibration can be performed either during production or during startup of a chip. For example, a chip including the bandgap circuit 200 can include a non-volatile memory that stores the desired voltage level, which is used to calibrate the bandgap circuit during production. As another example, during the initialization of a chip, an external voltage reference can be provided to calibrate the bandgap circuit, for example, by using a calibration process as described above.

The transistor 220 is configured to provide a current that is proportional to absolute temperature (PTAT). The transistor 220 is coupled to the transistor 107 to create a current mirror. That is, the current through the transistor 220 mirrors the current through the transistor 107. The current through transistor 107, 108 and 220 are all proportional to absolute temperature. Compared to the bandgap circuit 100 illustrated in FIG. 1, the current flowing through the transistor 101 of FIG. 2 additionally include the current flowing through the resistor ladder 202. The current through the transistor 101 is the sum of the current through the bandgap core 130 and the resistor ladder 202.

Compared to the bandgap circuit 100 illustrated in FIG. 1, the bandgap circuit 200 illustrated in FIG. 2 outputs a voltage that is temperature and process independent. The bandgap circuit 200 outputs a voltage $V_{BGTRIM}$ having a voltage level that can be calibrated. The output voltage $V_{BGTRIM}$ of the bandgap circuit 200 can be adjusted to be substantially consistent across different samples of the chips which may be fabricated by different fabrication processes. In addition, the resistor ladder operates independently from the bandgap core 130 and does not introduce interference or noise that may affect the flatness of the output voltage of the bandgap core 130.

Other topologies of the bandgap core 130 can also be used. For example, the MOS transistors 101, 102, 107, and 108 are be replaced with BJTs. The MOSFETs can operate in the subthreshold conduction mode (i.e., the gate-to-source voltage is below the threshold voltage.). The BJT transistors can operate in the forward-active region. The BJT transistors can be NPN or PNP type.

Upon reading this disclosure, those of skill in the art will appreciate still additional alternative designs. Thus, while particular embodiments and applications of the present disclosure have been illustrated and described, it is to be understood that the embodiments are not limited to the precise construction and components disclosed herein and that various modifications, changes and variations which will be apparent to those skilled in the art may be made in the arrangement, operation and details of the method and apparatus of the present disclosure disclosed herein without departing from the spirit and scope of the disclosure as defined in the appended claims.

What is claimed is:

1. A semiconductor product comprising a bandgap circuit including:

a bandgap core configured to output a first voltage independent of temperature;

a resistor ladder coupled to the bandgap core and to scale the first voltage into multiple voltage levels proportional to the first voltage, the resistor ladder including multiple resistors connected in series and multiple taps, each tap corresponding to a voltage level of the multiple voltage levels, each tap connected to a terminal of one of the multiple resistors; and an output switch configured to connect an output terminal of the bandgap circuit to a first tap of the multiple taps in response to the first voltage having a first value, and to connect the output terminal of the bandgap circuit to a second tap of the multiple taps in response to the first voltage having a second value.

2. The semiconductor product of claim 1 comprising a semiconductor die including the bandgap circuit.

3. The semiconductor product of claim 1 wherein a number of the multiple resistors is selected according to a desired level of voltage adjustment.

4. The semiconductor product of claim 1 wherein the multiple resistors have a same resistance.

5. The semiconductor product of claim 1 wherein the bandgap core is coupled between a power supply and a ground.

6. The semiconductor product of claim 1 wherein the bandgap circuit further comprises a semiconductor device configured to supply a first current to the bandgap core and a second current to the resistor ladder, and wherein the semiconductor device is coupled to a power supply.

7. The semiconductor product of claim 6, wherein the semiconductor device is a bipolar junction transistor.

8. The semiconductor product of claim 6, wherein the semiconductor device is a metal-oxide semiconductor field-effect transistor.

9. The semiconductor product of claim 6, wherein the semiconductor device is controlled according to a current difference between a current through a first current branch and a current through a second current branch in the bandgap core, the first current branch in parallel to the second current branch and the first current being a sum of the current through the first current branch and the current through the second current branch.

10. The semiconductor product of claim 1, wherein the bandgap core includes a first current branch configured to generate a proportional to absolute temperature current.

11. The semiconductor product of claim 10, wherein the bandgap core further includes a second current branch in parallel to the first current branch, the second current branch configured to operate at the proportional to absolute temperature current.

12. The semiconductor product of claim 10, wherein the bandgap core further includes a second current branch in parallel to the first current branch, the first current branch including a first semiconductor device coupled to a resistor in series, and the second current branch including a second semiconductor device, a voltage difference between a first threshold voltage of the first semiconductor device and a second threshold voltage of the second semiconductor device configured to generate the proportional to absolute temperature current through the resistor.

13. The semiconductor product of claim 12, wherein a temperature coefficient of the first threshold voltage and a temperature coefficient of the voltage difference between the first threshold voltage and the second threshold voltage have opposite signs.

14. The semiconductor product of claim 1, wherein the bandgap circuit further comprises a semiconductor device configured to output an output current, the semiconductor device mirroring a current branch of the bandgap core configured to generate a proportional to absolute temperature current.

15. A method of supplying a voltage to an integrated circuit, comprising:

generating a first voltage independent of temperature using a bandgap core;

generating multiple voltage levels proportional to the first voltage using a resistor ladder, the resistor ladder including multiple resistors connected in series and multiple taps, each tap corresponding to a voltage level of the multiple voltage levels, each tap connected to a terminal of one of the multiple resistors;

selecting a tap of the multiple taps corresponding to a voltage level that is substantially equal to a desired voltage level, wherein a first tap of the multiple taps is selected in response to the first voltage having a first value, and a second tap of the multiple taps is selected in response to the first voltage having a second value; and switching an output switch to the selected tap.

16. The method of claim 15, wherein selecting the tap comprises identifying the voltage level by comparing the desired voltage level to the voltage levels.

17. The method of claim 15, further comprising providing the desired voltage level by an external voltage source.

18. The method of claim 15, further comprising providing the desired voltage level stored in a non-volatile memory.

* * * * *